US005890724A

United States Patent [19]

Gignoux et al.

[11] Patent Number: 5,890,724

[45] Date of Patent: Apr. 6, 1999

[54] IN-LINE ROLLER SKATE

[75] Inventors: Pierre Gignoux, Le Sappey-en-Chartreuse; Joseph Polidori, Grenoble, both of France

[73] Assignee: Skis Rossignol S.A., Voiron, France

[21] Appl. No.: 790,709

[22] Filed: Jan. 29, 1997

[30] Foreign Application Priority Data

Jan. 29, 1996 [FR] France ..... 96 01242

[51] Int. Cl.[6] ..... A63C 17/06

[52] U.S. Cl. ..... 280/11.28; 280/11.27; 280/11.23; 280/11.22; 280/11.19

[58] Field of Search ..... 280/11.19, 11.22, 280/11.23, 11.27, 11.28

[56] References Cited

U.S. PATENT DOCUMENTS

| | | | |
|---|---|---|---|
| 3,749,413 | 7/1973 | Nicolson . | |
| 5,232,231 | 8/1993 | Carlsmith . | |
| 5,403,413 | 4/1995 | Masuda . | |
| 5,405,156 | 4/1995 | Gonella | 280/11.28 |
| 5,503,413 | 4/1996 | Belogour | 280/11.22 |
| 5,582,418 | 12/1996 | Closser | 280/11.22 |
| 5,586,774 | 12/1996 | Dentale | 280/11.22 |
| 5,741,019 | 4/1998 | Lu | 280/11.22 |

FOREIGN PATENT DOCUMENTS

| | | | |
|---|---|---|---|
| 0 192 312 | 8/1986 | European Pat. Off. . | |
| 2 659 534 | 9/1991 | France . | |
| 870 2068 | 4/1989 | Netherlands . | |
| 2178666 | 2/1987 | United Kingdom | 280/11.23 |
| WO93/12846 | 7/1993 | WIPO | 280/11.28 |
| WO93/12847 | 7/1993 | WIPO | 280/11.28 |

*Primary Examiner*—D. Glenn Dayoan
*Assistant Examiner*—Clovia Hamilton
*Attorney, Agent, or Firm*—Kane,Dalsimer, Sullivan,Kurucz, Levy,Eisele and Richard, LLP

[57] ABSTRACT

An in-line roller skate comprising an upper chassis (2) on which a boot (1) is fixed, and a lower chassis (4) bearing at least two rollers (5, 6, 7, 8). The upper chassis (2) is articulated onto the lower chassis (4) in the anterior region of the two chassis, within the perimeter of a square (A) which has a side length of 150 mm, which rests on the ground, which contains the front roller (5) and whose anterior vertical side passes just in front of this front roller. The upper chassis is further mounted elastically on the lower chassis. The suspension of the skate is provided without prejudicing the stability and the capacity of the skate for being steered.

17 Claims, 11 Drawing Sheets

FIG.7
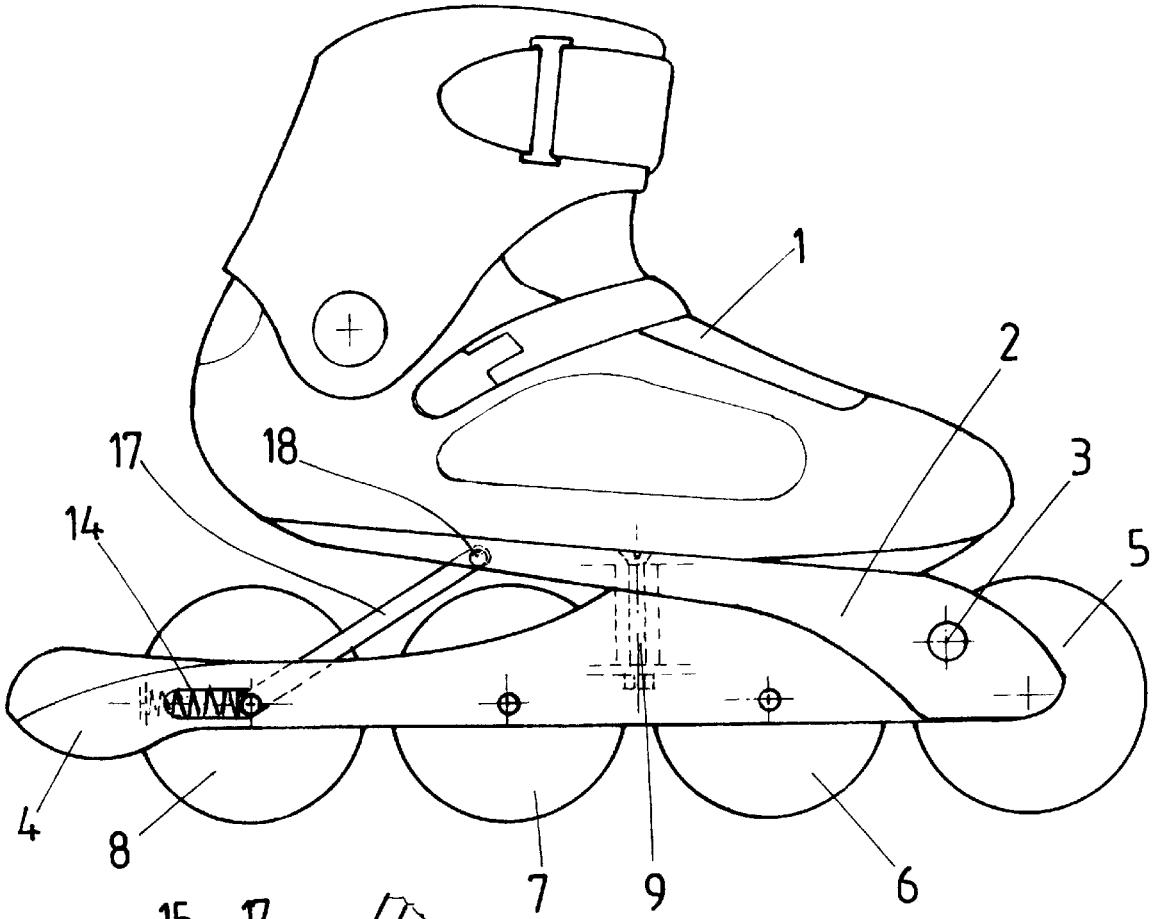
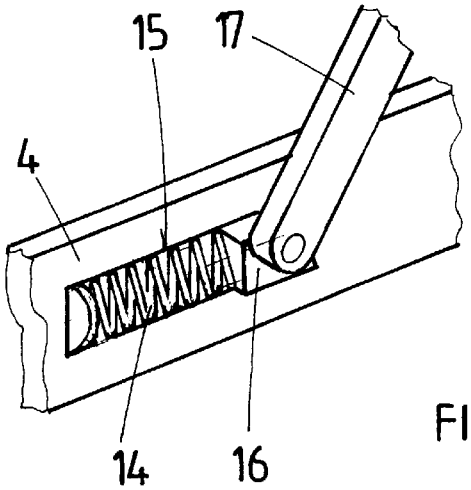
FIG.8

FIG. 16
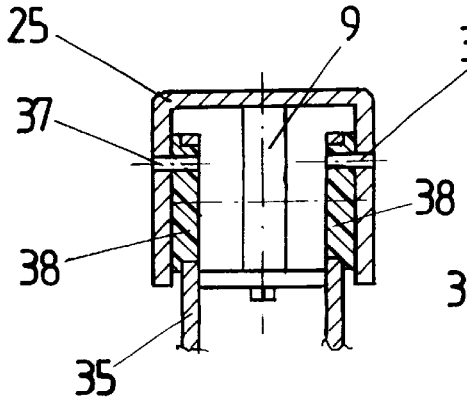
FIG. 17
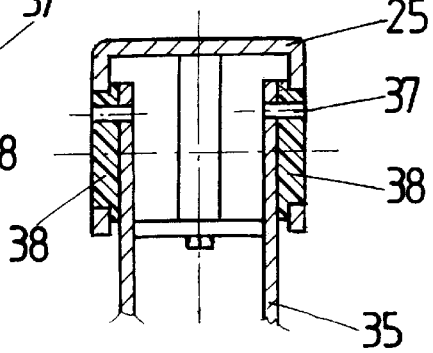
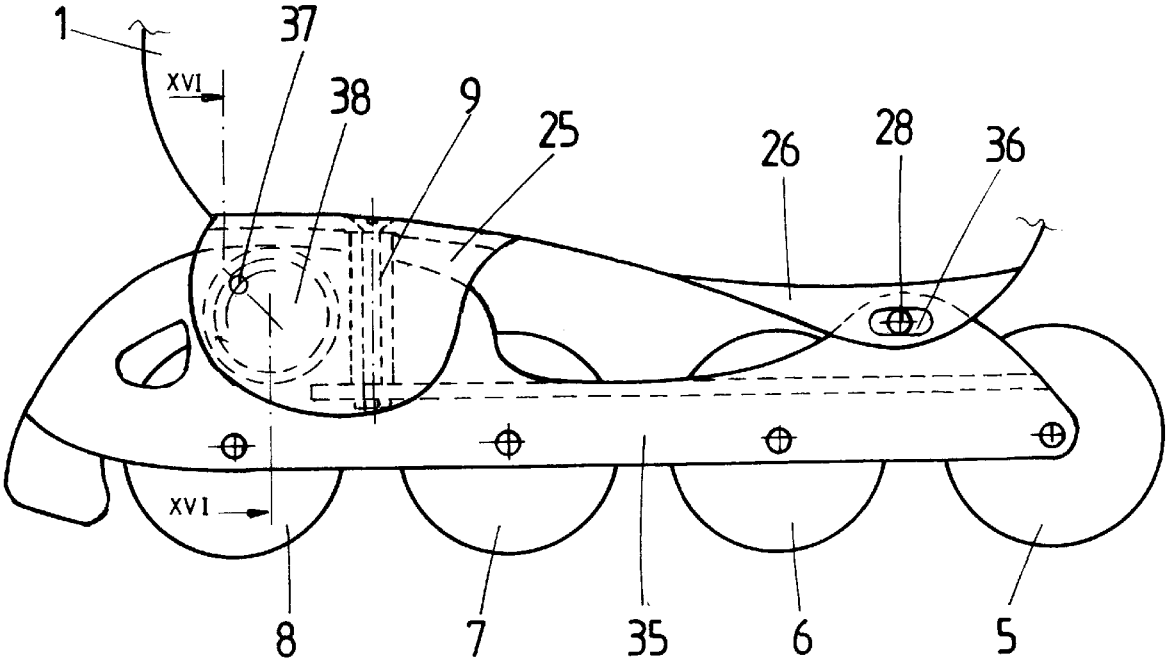
FIG. 15

IN-LINE ROLLER SKATE

FIELD OF THE INVENTION

The subject of the present invention is an in-line roller skate comprising an upper chassis on which a boot is fixed, and a lower chassis which bears at least two rollers, including the rear roller, and onto which the upper chassis is articulated about a pin parallel to the axle of the rollers, and elastic shock absorption means between the two chassis, counteracting the tilting of the upper chassis relative to the lower chassis.

PRIOR ART

U.S. Pat. No. 5,405,156 discloses an in-line roller skate comprising an upper chassis which bears the boot and is articulated in its central part onto the ends of two lower chassis, each bearing two rollers. A spring, working in compression, is arranged between the free ends of the two chassis and the upper chassis. In addition, an auxiliary elastic device of adjustable hardness, making it possible to adjust the degree of shock absorption, is mounted between each of these springs and the articulation of the two lower chassis.

In addition, GB Patent 2,160,780 discloses a skate with two in-line rollers mounted at the ends of a lower chassis, at the center of which an upper chassis bearing the boot is articulated. This skate is equipped with a brake on the rear roller, and elastic means counteracting the rearward tilting of the upper chassis.

In addition, it is proposed in International Patent Application WO 95/28209 to mount a boot on a chassis by means of springs placed to the front and to the rear of the boot.

All these designs have the drawback of the boot being unstable, making the skate difficult to steer. This instability is due to both forward and rearward tilting of the boot about a defined or undefined axis located under the central part of the boot.

SUMMARY OF THE INVENTION

The object of the present invention is to produce a skate with a suspended upper chassis, without prejudicing the skater's stability and the capacity of the skate for being steered.

The roller skate according to the invention is one in which the articulation of the upper chassis on the lower chassis is located in the anterior region of the two chassis, within the perimeter of a square which has a side length of 150 mm, which contains the front roller and whose anterior vertical side passes just in front of the front roller and whose lower side is the ground.

The elastic shock absorption means may be located to the rear of the articulation of the two chassis, on this articulation or to the front of the articulation.

The skate is preferably equipped with adjustable prestressing means making it possible to adjust the hardness of the suspension, that is to say the damping. These means may optionally be auxiliary damping means.

The front roller may be mounted either on the lower chassis or on the upper chassis.

The articulation of the upper chassis in its anterior part, close to the end of the boot, makes it possible to keep good stability and easy and accurate skate control while making it possible to obtain very good shock absorption. Indeed, the shock sensitivity actually lies in the vicinity of the heel by which the shocks are transmitted to the leg. An elastic suspension to the front proves superfluous.

BRIEF DESCRIPTION OF THE DRAWINGS

The appended drawing represents, by way of example, several embodiments of the invention.

FIG. 7 represents a third embodiment.

FIG. 8 is a detail view of FIG. 7.

FIG. 15 represents a ninth embodiment.

FIG. 16 is a partial view in section on XVI—XVI in FIG. 15.

FIG. 17 represents an alternative of the embodiment represented in FIG. 16.

DESCRIPTION OF THE PREFERRED EMBODIMENTS

Figure 1:
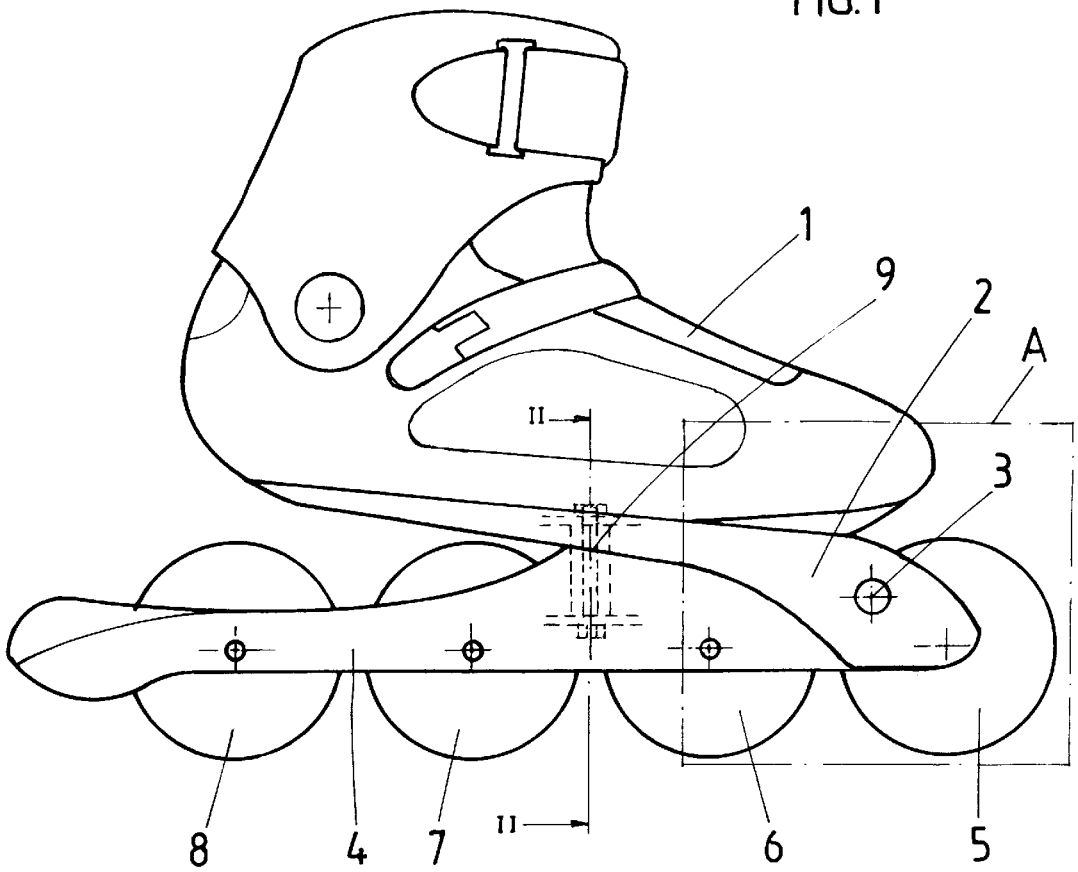
FIG. 1 represents the simplest embodiment.
Figure 2:
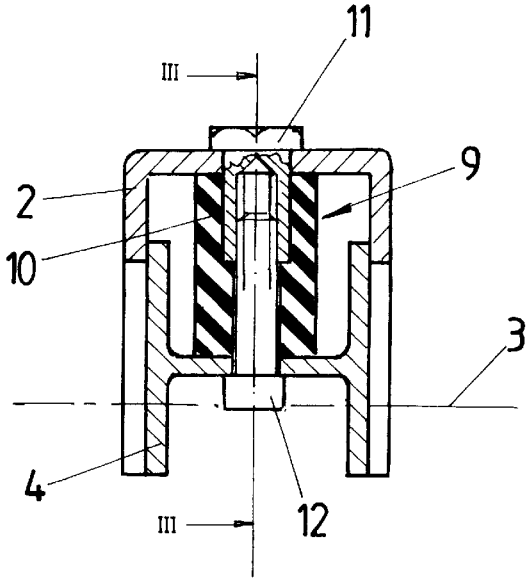
FIG. 2 is a detail view in section taken along the line II—II of FIG. 1.
Figure 3:
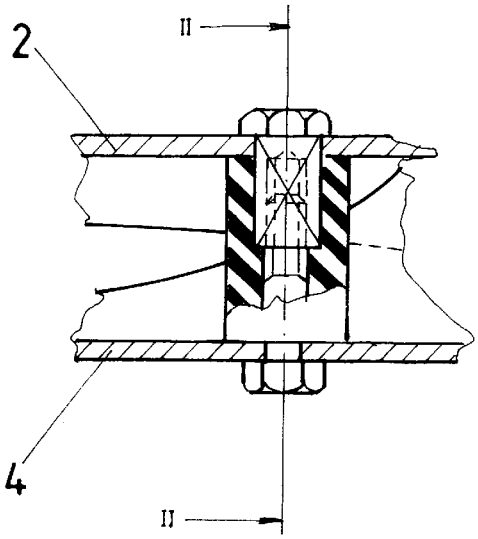
FIG. 3 represents a view in section on III—III in FIG. 2.

FIG. 1 shows a boot 1, mounted on an upper chassis 2 which is articulated about a pin 3 onto a lower chassis 4 which bears four in-line rollers 5, 6, 7, 8. The pin 3 is located slightly to the rear and above the axle of the anterior roller 5. In addition, the upper chassis 2 is supported by a damper device 9 mounted between the two chassis 2 and 4, between the central rollers 6 and 7, that is to say under the central part of the boot. This device 9 is represented in detail in FIGS. 2 and 3. In addition, as shown by FIG. 2, the upper chassis 2 has a U-shaped profile and the lower chassis 4 has an H-shaped profile which fits into the upper chassis 2, so that this upper chassis 2 is guided laterally on the lower chassis 1. The damper device 9 consists of an elastomer sleeve 10 in which a bush 11 is engaged. This bush 11 is provided with an internal screw thread in which a screw 12, the head of which bears on the transverse part of the lower chassis 4, is engaged. The bush 11 and the screw 12 allow compressive prestressing of the sleeve 10 and thereby adjustment of the hardness of the damper device. It may be noted that the damper device 9 is sheltered in a housing formed by the two chassis 2 and 4. The damper device 9 could be located at a different point, for example under the heel or close to the pin 3.

The square A, lying in a longitudinal plane, defines the region in which the articulation 3 of the upper chassis onto the lower chassis may be located while retaining the advantages of a single anterior articulation. The square A measures 150 mm in side length. Its lower side coincides with the ground and its anterior vertical side passes just in front of the front roller 5.

Figure 4:
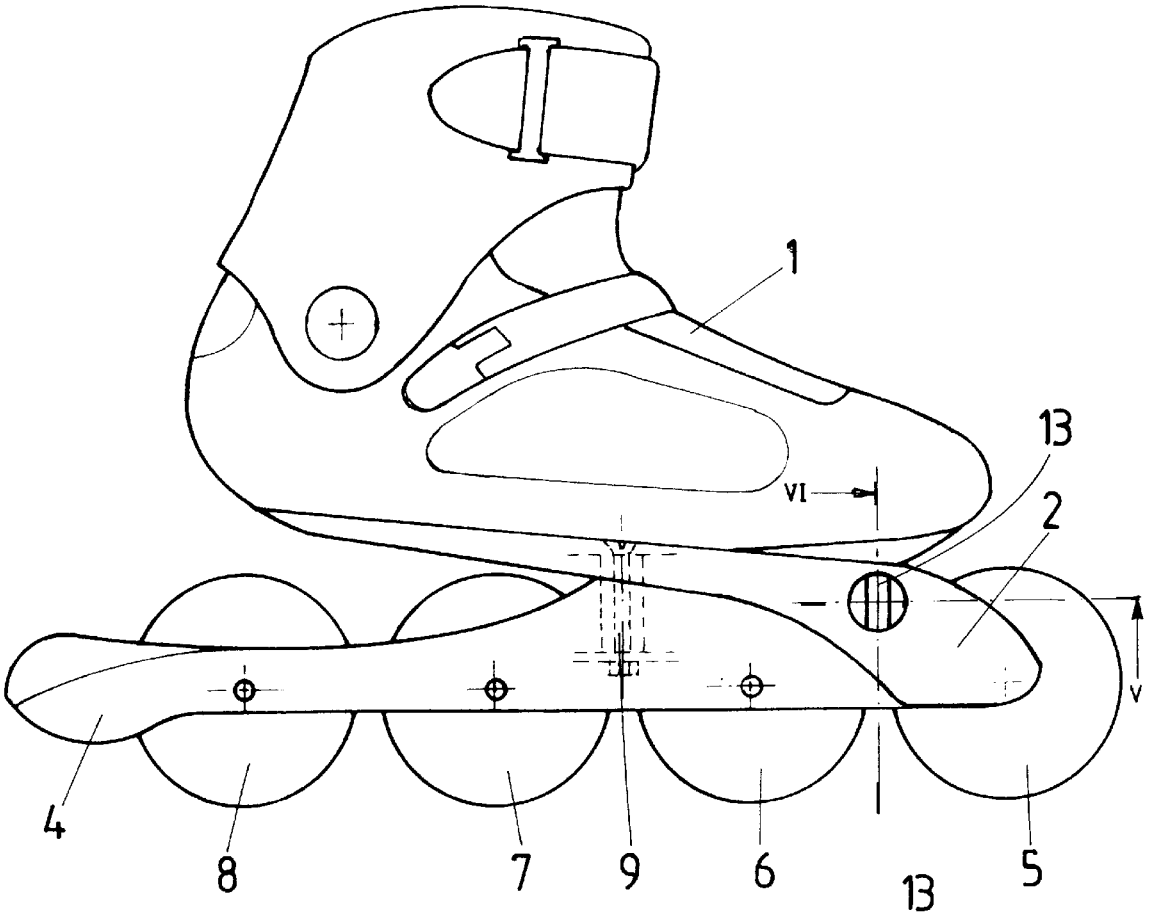
FIG. 4 represents a second embodiment.
Figure 5:
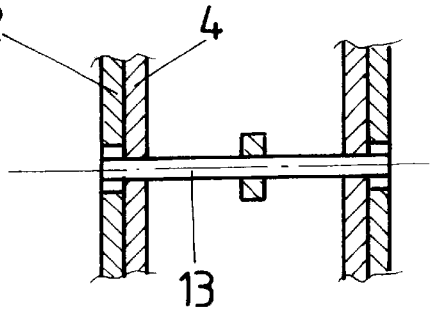
FIG. 5 is a detail view in section on V—V in FIG. 4.
Figure 6:
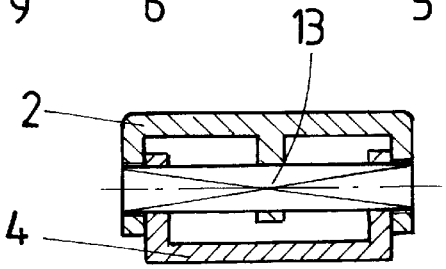
FIG. 6 represents the same detail view in section on VI—VI in FIG. 4.

The skate represented in FIG. 4 differs from the skate represented in FIG. 1 only by the replacement of the simple pin 3 by a torsion bar 13 and by the use of less hard rubber for the sleeve 10 of the device 9. In this case, the suspension is mainly provided by the torsion bar 13, the device 9 then being no more than a damper device which additionally makes it possible to create a prestress for adjusting the hardness of the suspension of the upper chassis.

The torsion bar could be replaced by a torsion spring.

The skate represented in FIGS. 7 and 8 is also derived from the basic embodiment represented in FIG. 1. The main elastic means here consists of a spring 14 which is mounted horizontally in a housing 15 formed in the lower chassis 4 and works in compression under the pressure of a slide 16 mounted at the end of a rod 17 which is articulated by its other end, at a point 18, onto the upper chassis 2. The axle of the roller 8 is also the pin articulating the rod 17 onto the slide 16, so that the roller 8 moves with the slide 16. The device 9 fulfills the same role as in the embodiment represented in FIG. 4.

The housing 15 and the slide 16 could be located to the front of the axle of the roller 8.

Figure 9:
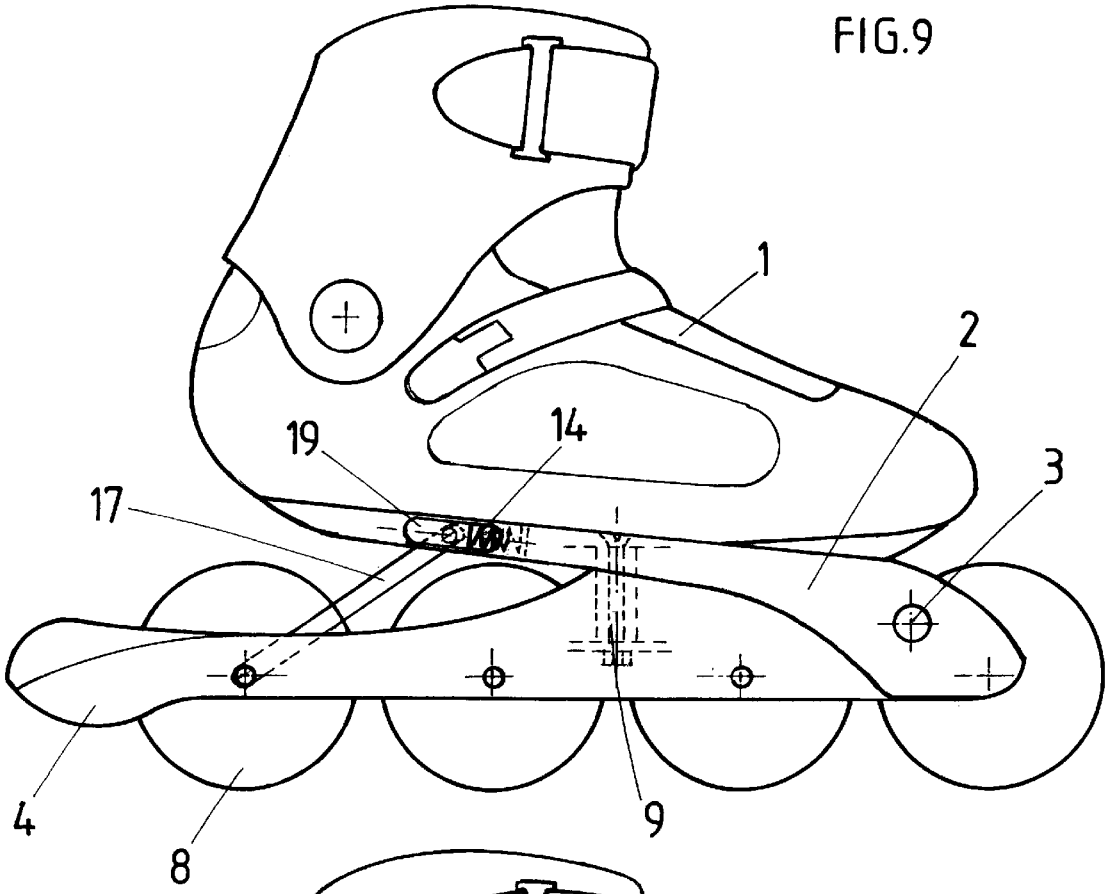
FIG. 9 represents a fourth embodiment.

FIG. 9 represents a variant of the embodiment represented in FIG. 7. The spring 14 is here mounted in a housing 19 which is formed in the upper chassis 2, slightly to the front of the heel. The lower end of the rod 17 is articulated onto the axle of the posterior roller 8.

Figure 10:
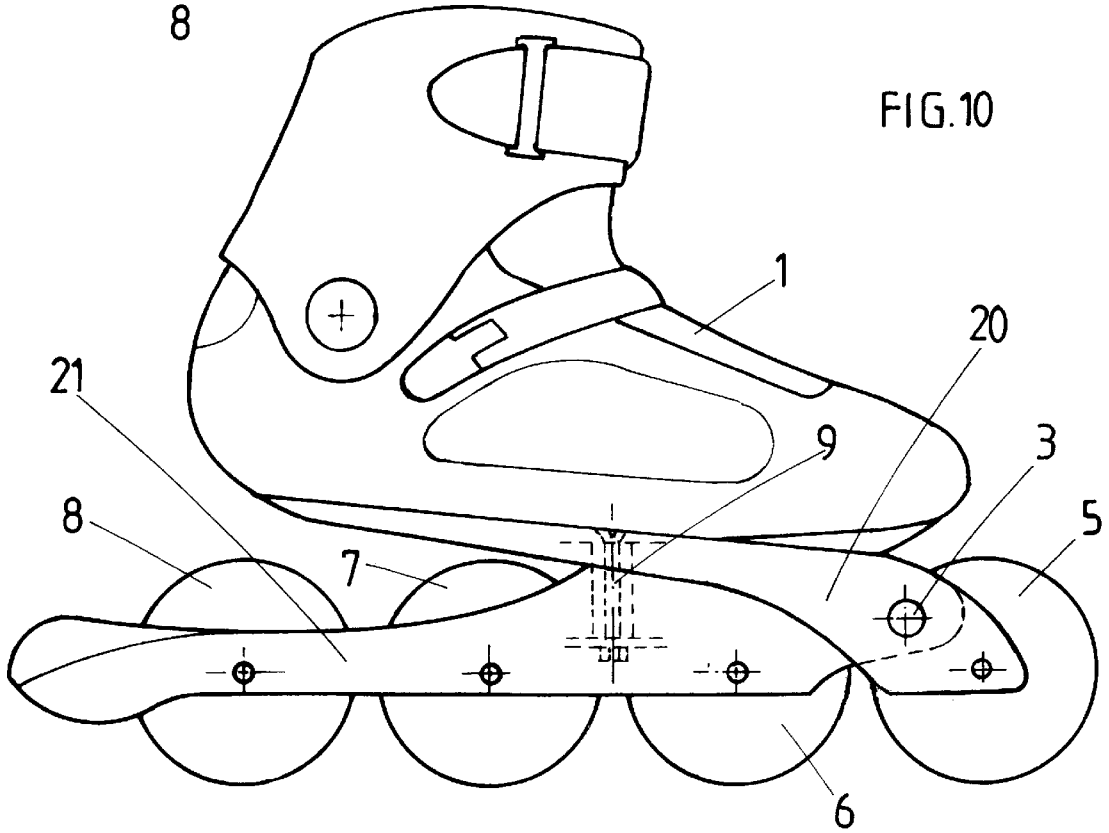
FIG. 10 represents a fifth embodiment.

In the embodiment represented in FIG. 10, the boot 1 is fixed onto an upper chassis 20, the shape of which is substantially identical to that of the chassis 2. The front roller 5 is mounted at the end of this chassis 20 and, at the front, the lower chassis 21, onto which the upper chassis 20 is articulated about a simple pin 3, has a shape which frees the axle of the roller 5. The damper device 9 is identical to the one in the basic embodiment represented in FIG. 1.

This embodiment makes it easier and more comfortable to clear slight bumps on uneven ground.

The pin 3 could, of course, be equipped with a torsion spring or be replaced by a torsion bar.

Figure 11:
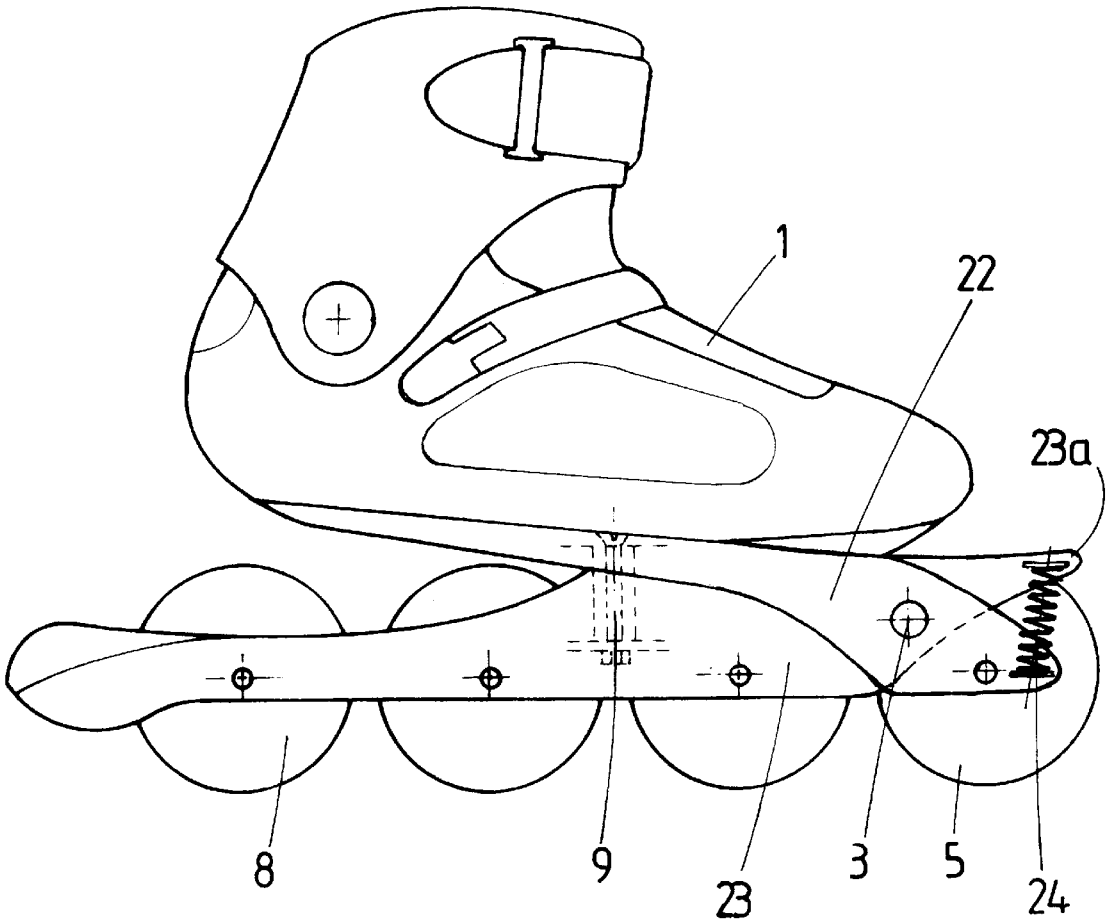
FIG. 11 represents a sixth embodiment.

The embodiment represented in FIG. 11 is derived from the preceding embodiment. The anterior roller 5 is again mounted on the upper chassis 22 which is articulated onto a lower chassis 23 about a simple pin 3. This lower chassis 23 has an anterior extension 23*a* extending above the anterior end of the upper chassis 22. A spring 24, working in tension, is mounted between the ends of the two chassis. The device 9*a* again has a function of adjusting the hardness of the suspension.

Figure 13:
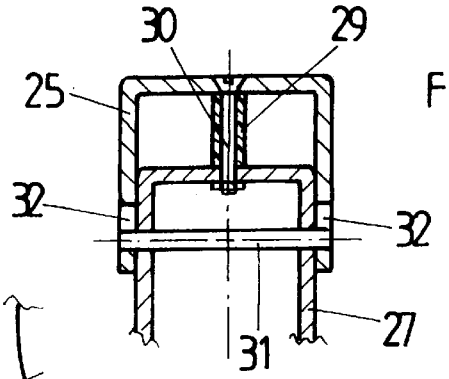
FIG. 13 is a view in section on XIII—XIII in FIG. 12.
Figure 12:
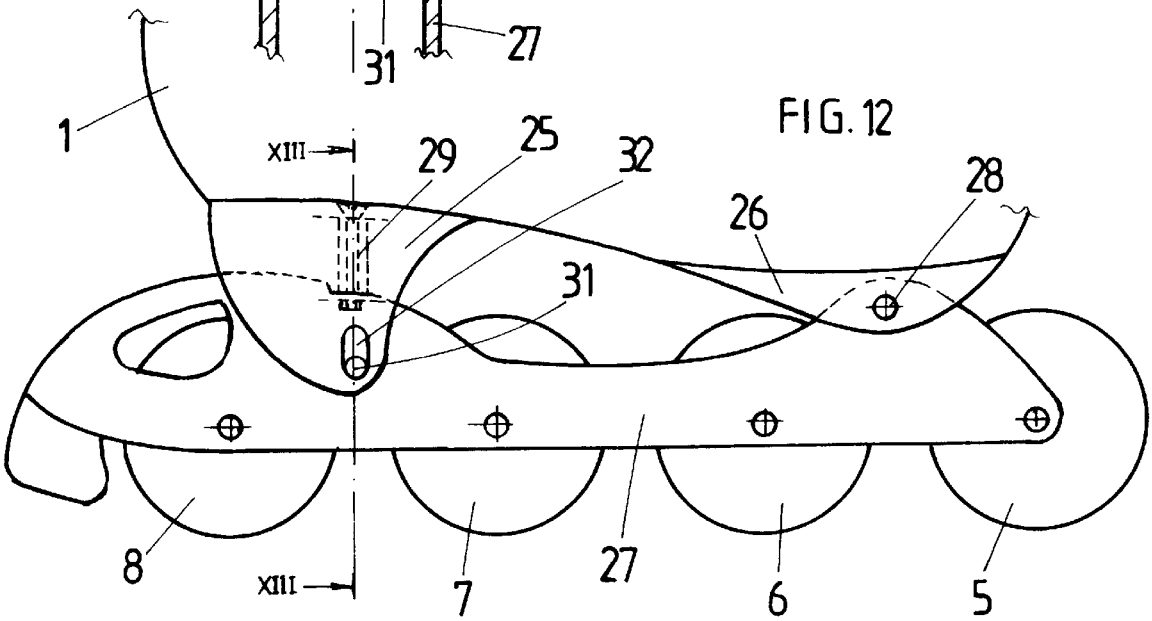
FIG. 12 represents a seventh embodiment.

FIGS. 12 and 13 partially represent a seventh embodiment, in which the upper chassis consists of two parts 25 and 26 which are integrated with the sole of the boot and have a U-shaped profile into which a lower chassis 27, also consisting of a U-shaped profile, fits. The four rollers 5 to 8 are mounted on the lower chassis 27. The anterior part 26 of the upper chassis is articulated onto the lower chassis 27 about a pin 28 which is located between the two anterior rollers 5 and 6. The posterior part 25 of the upper chassis bears on the lower chassis 27 via a relatively hard elastic sleeve 29 guided by a shaft 30. The travel of the two chassis is limited by a transverse bar 31 which is fixed to the lower chassis 27 and the ends of which are engaged in two vertical slots 32 formed in the upper chassis 25.

Figure 14:
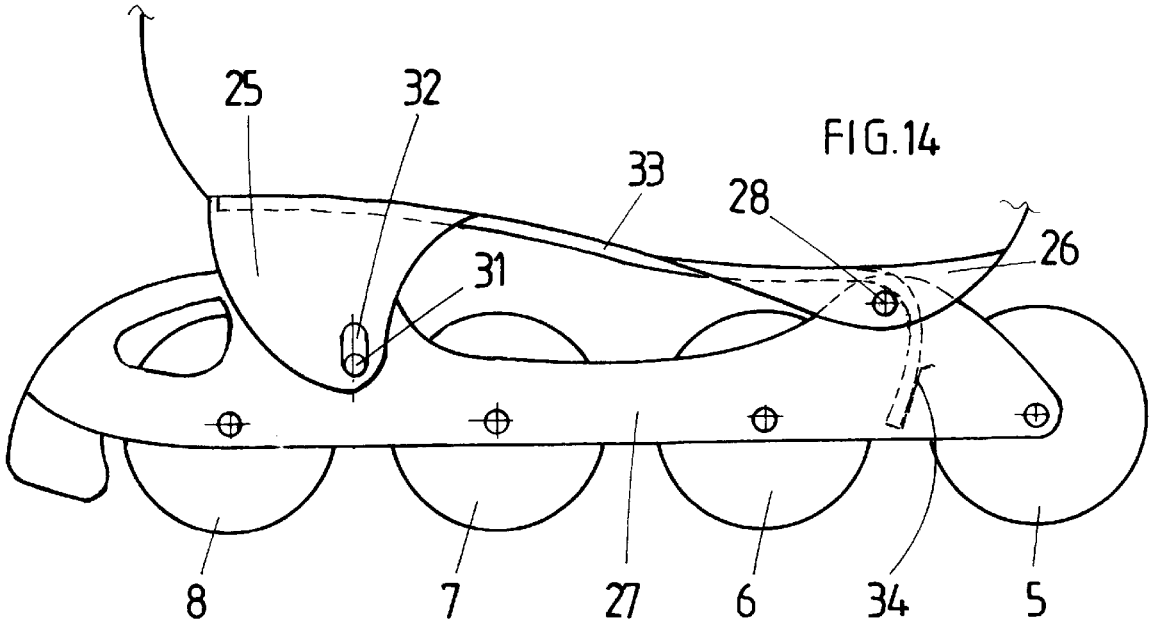
FIG. 14 represents an eighth embodiment.

FIG. 14 represents an eighth embodiment, derived from the preceding embodiment. The elastic sleeve 29 is here replaced by a leaf spring 33 which extends under the upper chassis, passes above and in front of the articulation pin 28 and, via a bent part, bears against two bearing zones 34 formed on each of the sides of the lower chassis 27, between the anterior rollers 5 and 6. The leaf spring 33 is preferably prestressed when fitted.

As a variant, the leaf spring 33 could bear on the chassis 27 between the rollers 6 and 7.

A ninth embodiment is represented in FIGS. 15 and 16. The boot is again mounted on an upper chassis made of two U-shaped profiled parts 25 and 26. The anterior part 26 is articulated onto a lower chassis 35 which, over most of its length, has an H-shaped profile provided with passages for the rollers. The four rollers 5, 6, 7, 8 are mounted on the lower chassis 35. The articulation pin 28 of the two chassis is fixed in the lower chassis 35, and its ends are engaged in two horizontal slots 36 formed in the lateral faces of the part 26 of the upper chassis. The posterior part 25 of the upper chassis is provided with two lateral cranks 37, respectively engaged freely in two disks 38 made of a material having a low coefficient of friction, for example DELRIN (registered trademark) which are mounted so as to rotate in circular cutouts in the lateral faces of the chassis 35. Elastic suspension is provided by a device similar to that in the basic embodiment. In the absence of a load, the cranks 37 are located at about 40° to the rear of the uppermost point of the disks 38. The slots 36 allow longitudinal displacements of the upper chassis, and consequently rotation of the disks 38 under load. These slots may also limit the rotation of the disks 38, that is to say the vertical travel of the upper chassis.

FIG. 17 represents an alternative embodiment, in which the disks 38 are mounted so as to rotate in the upper chassis 25. The disks 38 could be combined with a spring or replaced by a spring. In this case, the device 9 would fulfill the function of adjusting the damping hardness.

Figure 19:
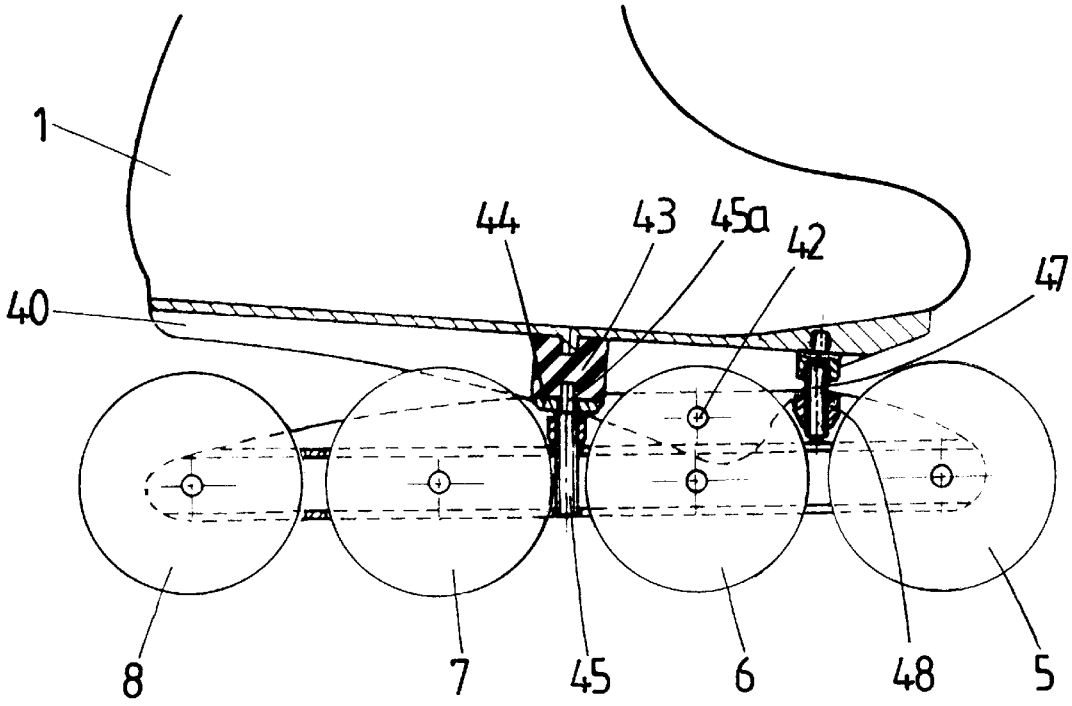
FIG. 19 is a view in axial vertical section of the two chassis of the skate represented in FIG. 18.
Figure 18:
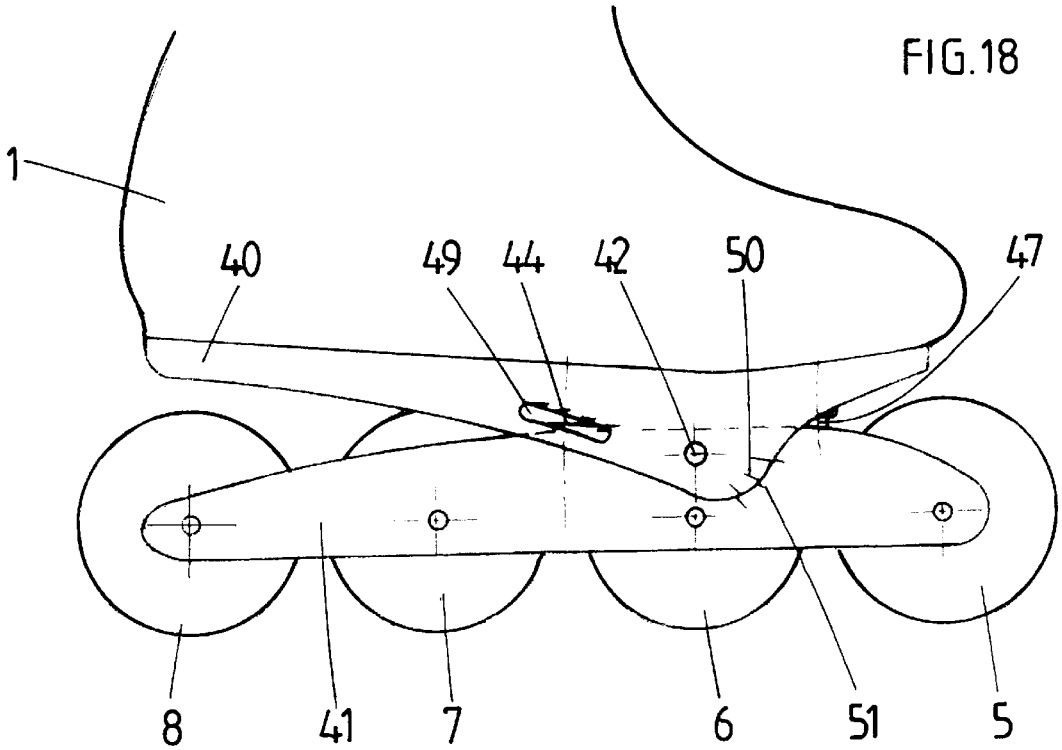
FIG. 18 represents a tenth embodiment.

The skate represented in FIGS. 18 and 19 comprises a U-shaped profiled upper chassis 40 articulated onto a lower chassis 41 about a pin 42 lying vertically in line with the axle of the second roller 6. The upper chassis 40 is elastically supported between the second roller 6 and the third roller 7 by a damper device consisting of an elastomer block 43, on the lower face of which is bonded a rigid plate 44 pierced with a hole in which is engaged, with clearance, the smooth, small-diameter end 45*a* of a screw 45 screwed into a nut 46 bearing on the lower chassis 41, so that the plate 44 bears on the end of the threaded part of the screw 45 while being capable of tilting slightly on this screw by virtue of the clearance. To the front, the upper chassis 40 bears on a stop 47 consisting of a screw screwed into a nut 48 secured to the lower chassis 41.

Actuating the screw 47 makes it possible to adjust the initial inclination of the upper chassis relative to the lower chassis. Since the front part of the upper chassis 40 abuts on the stop 47, the screw 45 makes it possible to precompress the elastic block 43 to a varying degree, that is to say to modify the hardness of the suspension. An oblique slot 49 in the upper chassis 40 makes it possible to see the position of the plate 44, and therefore the prestress of the block 43. Graduations make it possible to see this prestress. To the front, two sets of graduations 50 and 51 with different intervals, which are respectively provided on the upper chassis and on the lower chassis, make it possible, by aligning two graduations, to adjust the skate to three particular positions using the screw 47, ranging from a flexible position to a hard position. In addition, the effect of compressing the block 43 is to store energy when the skater bears on the skate in order to move forward, this energy being released when the skate leaves the ground.

Figure 20:
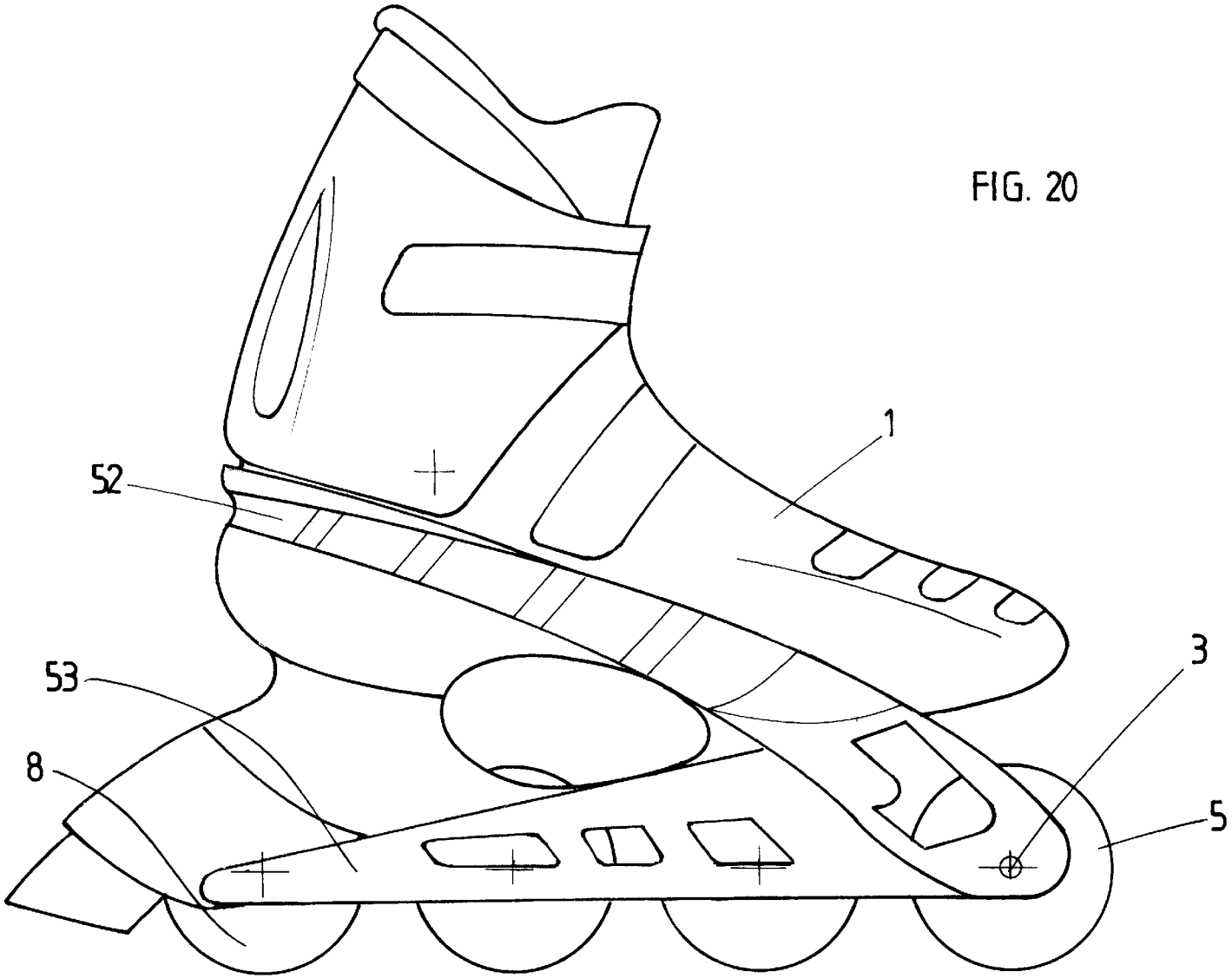
FIGS. 20, 21 and 22 represent three examples of integrating the upper chassis with the boot.
Figure 21:
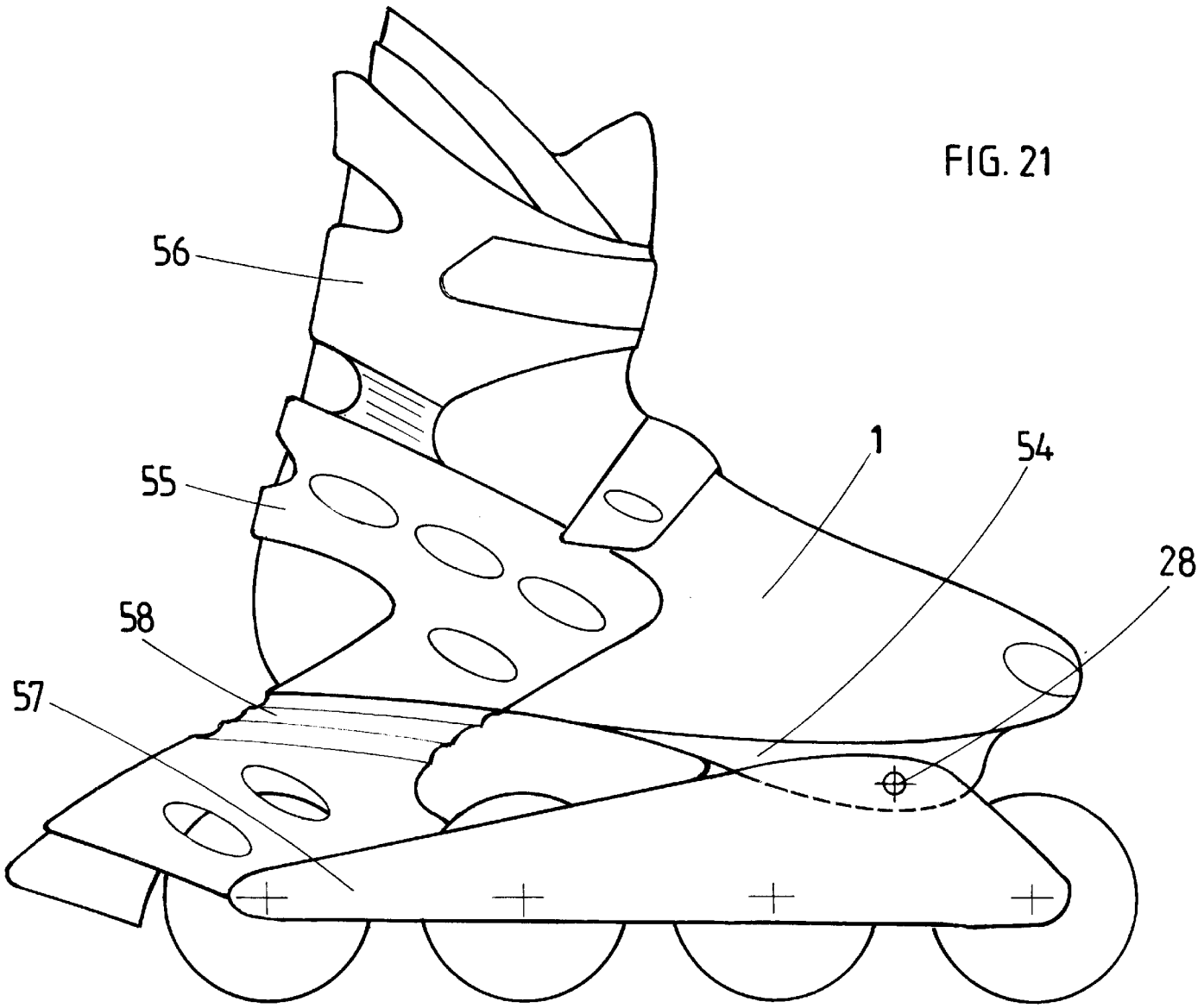
Figure 22:
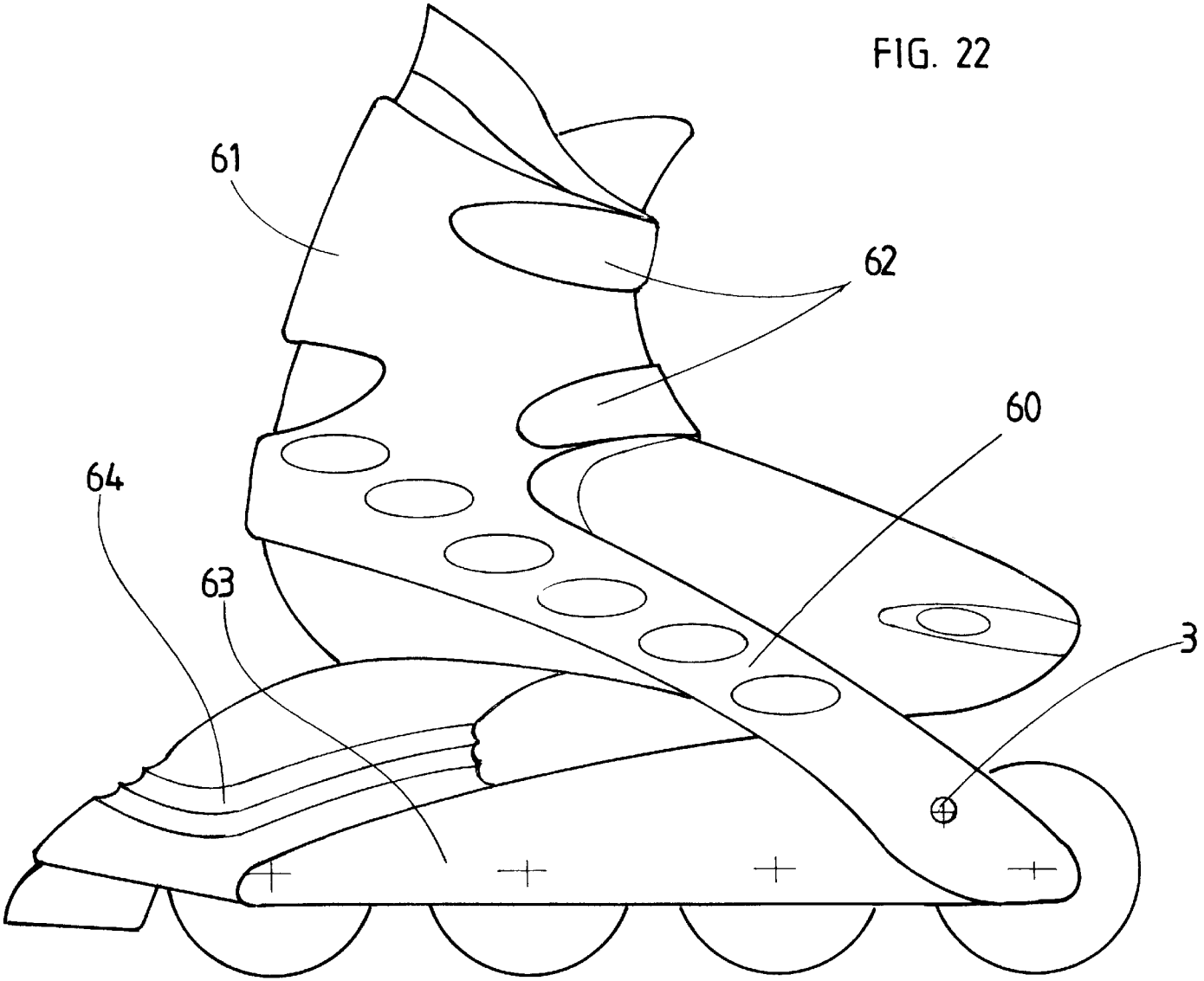

FIGS. 20, 21 and 22 illustrate embodiments in which the upper chassis is integrated with the boot.

In the embodiment according to FIG. 20, the upper chassis 52 extends around the rear of the boot 1 and obliquely in the direction of the front roller 5. It is also set into the boot, constituting a reinforcement which makes it easier to push on the ground. The two chassis 52 and 53 are articulated onto the axle of the front roller 5. In the heel region, the two chassis 52 and 53 are connected together by an elastic region or a region containing a damper.

The embodiment represented in FIG. 21 is derived from the embodiment represented in FIG. 12. The upper chassis consists of an anterior part 54, similar to the part 26 in FIG. 12, and a posterior part 55 extending around the rear of the boot, constituting a reinforcement for the boot, and optionally secured to a collar 56 enclosing the upper of the boot. The upper chassis 54 is connected to the lower chassis 57 by an elastic part 58.

In the embodiment according to FIG. 22, the upper chassis 60 extends obliquely along the sides of the boot and forms a collar 61 fitted with tightening means 62. The heel of the boot rests on the lower chassis 63 which has an elastic region 64.

We claim:

1. An in-line roller skate comprising an U-shaped upper chassis (2; 20; 22; 25; 26; 40; 52; 54; 55; 60) on which a boot (1) having a heel is fixed, and a lower chassis (4; 21; 23; 27; 35; 41; 53; 57; 63) having two-shaped parallel plates moveably engaged in the U-shaped profile of the upper chassis which bears at least two rollers (5, 6, 7, 8), including a rear roller (8), and a front roller (5) having an axle, and onto which the upper chassis is articulated about a pin (3; 13; 28; 42) parallel to the axles of the rollers so that the upper chassis is adapted to tilt relative to the lower chassis with the two parallel plates of the lower chassis guiding the movement of the upper chassis, and elastic damper means (9; 13; 14; 24; 29; 33; 43) between the two chassis and between the articulation and the heel, counteracting the tilting of the upper chassis relative to the lower chassis, wherein the articulation of the upper chassis on the lower chassis is located in the anterior region of the two chassis, within the perimeter of a square (A) which has a side length of 150 mm, which contains the front roller (5) and whose anterior vertical side passes just in front of the front roller (5) and whose lower side is the ground and, specifically the articulation of the upper chassis on the lower chassis being located above and to the rear of the axle of the front roller (5).

2. The skate as claimed in claim 1 wherein the front roller (5) is mounted on the lower chassis.

3. The skate as claimed in claim 1 wherein the front roller (5) is mounted on the upper chassis (20; 22).

4. The skate as claimed in claim 1 with four rollers, wherein the articulation (42) of the upper chassis (40) onto the lower chassis (41) is located within the perimeter of the second roller (6).

5. The skate as claimed in claim 1 wherein the upper chassis (52; 54; 60) constitutes a part of the boot.

6. The skate as claimed in claim 1 wherein the elastic means counteracting the tilting of the upper chassis consist of a spring and of a torsion bar (13) constituting the articulation pin of the two chassis.

7. The skate as claimed in claim 1 wherein the elastic means counteracting the tilting of the upper chassis consist of an elastic element (10) working in compression between the two chassis.

8. The skate as claimed in claim 1 wherein the elastic means counteracting the tilting of the upper chassis consist of a spring (14) mounted in one of the chassis and working in compression, in a substantially horizontal plane, and of an oblique rod (17) articulated onto the other chassis and bearing on the spring.

9. The skate as claimed in claim 8 wherein said spring (14) is mounted in the lower chassis (4) and wherein the rod (17) is articulated onto the axle of the rear roller (8), so that this roller moves when the spring is compressed.

10. The skate as claimed in claim 3 wherein the anterior end of the lower chassis (23) is located above the anterior end (23*a*) of the upper chassis (22), and wherein the elastic means counteracting the tilting of the upper chassis consist of a spring (24) working in tension between the anterior ends of the two chassis.

11. The skate as claimed in claim 1 which comprises, to the rear, means (31, 32; 38) limiting the travel of the upper chassis.

12. The skate as claimed in claim 1 wherein the means limiting the travel of the upper chassis (25) consist of a linkage with rotary disks (38) and eccentric cranks (37) between the two chassis, the front articulation having a horizontal clearance (36) allowing limited rotation of the crank.

13. The skate as claimed in claim 1 wherein the elastic means counteracting the tilting of the upper chassis consist of a leaf spring (33).

14. The skate as claimed in claim 1 which comprises adjustable prestressing means (9).

15. The skate as claimed in claim 14 wherein the prestressing means are combined with said elastic means (9; 45).

16. The skate as claimed in claim 14 wherein the prestressing means (9) are separate From said elastic means.

17. The skate as claimed in claim 1, wherein the damper means comprises a stop means (12) limiting tilting up of the upper chassis.

* * * * *